US006877874B2

(12) United States Patent
Chauquet

(10) Patent No.: US 6,877,874 B2
(45) Date of Patent: Apr. 12, 2005

(54) ILLUMINATING FIXTURE FOR ENCLOSED SPACE CONTAINING A HUMID ENVIRONMENT

(75) Inventor: Jacques Chauquet, Bonneville (FR)

(73) Assignee: Rena S.A. (FR)

( * ) Notice: Subject to any disclaimer, the term of this patent is extended or adjusted under 35 U.S.C. 154(b) by 99 days.

(21) Appl. No.: 10/343,505

(22) PCT Filed: Aug. 2, 2001

(86) PCT No.: PCT/FR01/02534

§ 371 (c)(1),
(2), (4) Date: Jun. 23, 2003

(87) PCT Pub. No.: WO02/10641

PCT Pub. Date: Feb. 7, 2002

(65) Prior Publication Data

US 2004/0022059 A1 Feb. 5, 2004

(30) Foreign Application Priority Data

Aug. 2, 2000 (FR) ..... 00 10224

(51) Int. Cl.[7] ..... F21V 33/00
(52) U.S. Cl. ..... 362/101; 362/267; 362/310
(58) Field of Search ..... 362/101, 96, 267, 362/310, 253; 119/226, 174

(56) References Cited

U.S. PATENT DOCUMENTS 3,133,704 A 5/1964 Kampmann
4,021,660 A * 5/1977 Szpur ..... 362/218
4,042,819 A * 8/1977 Dacal ..... 362/222
5,479,327 A 12/1995 Chen
5,546,289 A * 8/1996 Gordon ..... 362/101
6,135,620 A * 10/2000 Marsh ..... 362/377

FOREIGN PATENT DOCUMENTS

| | | |
|---|---|---|
| BE | 497 895 | 1/1951 |
| EP | 0 614 042 | 9/1994 |

* cited by examiner

*Primary Examiner*—Thomas M. Sember
(74) *Attorney, Agent, or Firm*—Cantor Colburn LLP

(57) ABSTRACT

A lighting fixture for an enclosed space having a humid environment is provided, including a tubular profiled section made of synthetic material having a rectilinear cross section arid a regular profile, and a support for electrical components including a metal blade with elastic properties having a width generally corresponding to an interior width of the profiled section including a base for resting against a face of the profiled section, two end returns disposed generally perpendicular to the base and having a height slightly smaller than that of the profiled section, two facing flanges extend respectively from the two end returns including ends for anchoring in an upper wall of the profiled section, and two end plugs for closing the ends of the profiled section, each plug including a part being pushed into the profiled section including an O-ring.

6 Claims, 2 Drawing Sheets

ILLUMINATING FIXTURE FOR ENCLOSED SPACE CONTAINING A HUMID ENVIRONMENT

FIELD OF INVENTION

The subject of the present invention is a lighting fixture for an enclosed space containing a humid environment, such as an aquarium, a garden pond or a fountain.

DESCRIPTION OF RELATED ART

The production of lighting fixtures intended to equip such enclosed spaces is known. Thus, in the case of an aquarium, the lighting fixture may be fixed to the lid thereof.

A lighting fixture consists of a tube containing the electrical supply components, and to which a sealed fluorescent tube is fixed.

There are two types of fixture on the market: fixtures made of thermoformed synthetic material and fixtures made of injection-molded synthetic material.

Fixtures of the first type are practically never sealed. Fixtures of the second type may be sealed, but in this case the end fittings have to be welded on and can no longer be removed. In consequence, in order to access the starter, it is necessary to provide a passage on a lateral face of the profiled section and to seal this passage.

In the conventional way, the electrical components are fixed on a mounting plate which is engaged in the slideways molded into the interior face of the profiled section, so as to hold this mounting plate away from the lateral face of the profiled section facing which it is located and to avoid heating thereof. It should be noted that since the slideways extend as far as the ends of the profiled section, this makes sealing at this region difficult. In consequence, existing fixtures are not perfectly sealed and cannot be immersed, because they exhibit the risk of electrocution.

SUMMARY OF THE INVENTION

The invention provides a fixture which is produced in a simple way, with a small number of components, which is perfectly sealed, without entailing either bonding or welding, and which can be opened up to allow possible maintenance of the electrical components that it contains.

To this end, the lighting fixture to which the invention relates comprises a tubular profiled section made of synthetic material, of square or rectangular cross section, having a regular profile, that is to say with no roughnesses on the inside, a support for the electrical components, this support consisting of a metal blade with elastic properties, of a width more or less corresponding to the interior width of the profiled section, comprising a base intended to rest against one of the faces of the profiled section, extended by two end returns which are roughly perpendicular to it and which have a height slightly smaller than that of the profiled section, themselves extended by two facing flanges, the ends of which are intended to anchor in the upper wall of the profiled section, and two end plugs for closing the ends of the profiled section, each plug comprising a part which, intended to be pushed into the profiled section, is fitted with an O-ring.

It should be noted that the profiled section has no slideway, that is to say has a regular profile allowing it to be closed by two pushed-in plugs, sealing being achieved by O-rings. The electrical components are, for their part, mounted on the support, the support being introduced into the profiled section once the flanges have been pushed down. When the support is in place, the flanges are released and the ends thereof anchor into the upper wall of the profiled section, thus translationally immobilizing the support in the profiled section. It should be noted that there is no need, as is usually the case, to provide slideways for mounting the support, thus making it possible to avoid suffering the disadvantages of the slideways which detract from the ability to provide sealing.

According to one advantageous embodiment of this fixture, the connection between the base of the support and each return is achieved via a curved surface, and the connection between each return and the associated flange is achieved by a pronounced fold, the metal blade being shaped in such a way that when no action is exerted on the flanges these are inclined upward with respect to the horizontal. This configuration of the regions of connection between the returns and, respectively, the base of the supports and the flanges, give the flanges an elasticity which allows them to brace against the upper wall of the profiled section.

To ensure good ventilation of the electrical components, the base of the support has at least two upwardly-facing discontinuities.

Advantageously, the end edge of each flange of the support is sharpened on its upwardly facing edge. This end edge may be obtained by suitable cutting of the ends of the support.

In order to improve the attachment of the flanges of the support with respect to the upper wall of the profiled section, each flange has at least one slot opening at its end.

According to another feature of the invention, the profiled section has two fixing and resting lugs extending one of its exterior walls, the connection between each lug and the body of the profiled section comprising a recess to keep the thickness identical to the thickness of material of the lug and the thickness of material of the profiled section. This arrangement makes it possible to avoid any local additional thickness of material which may result in defective sealing.

BRIEF DESCRIPTION OF THE DRAWINGS .

In any event, the invention will be clearly understood with the aid of the description which follows, with reference to the appended schematic drawing which, by way of nonlimiting example, depicts one embodiment of this lighting fixture.

Figure 1:
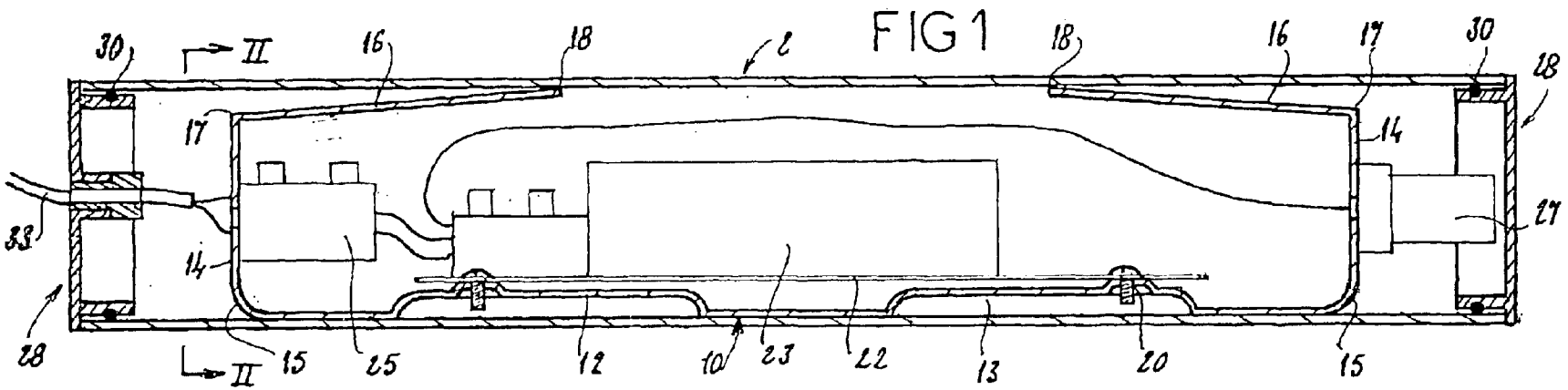
FIG. 1 is a view thereof in longitudinal section.
Figure 3:
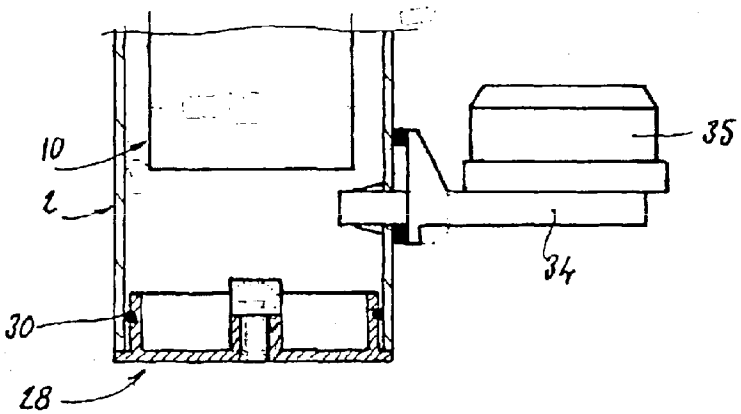
FIG. 3 is a view thereof in cross section on III-III of FIG. 2.
Figure 2:
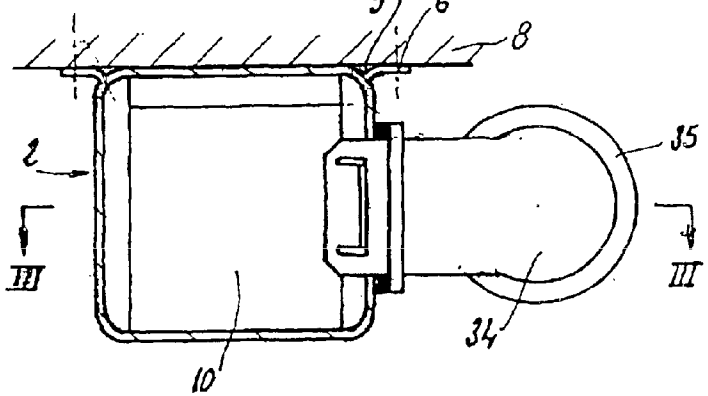
FIG. 2 is a view thereof in cross section on II-II of FIG. 1.
Figures 4, 5:
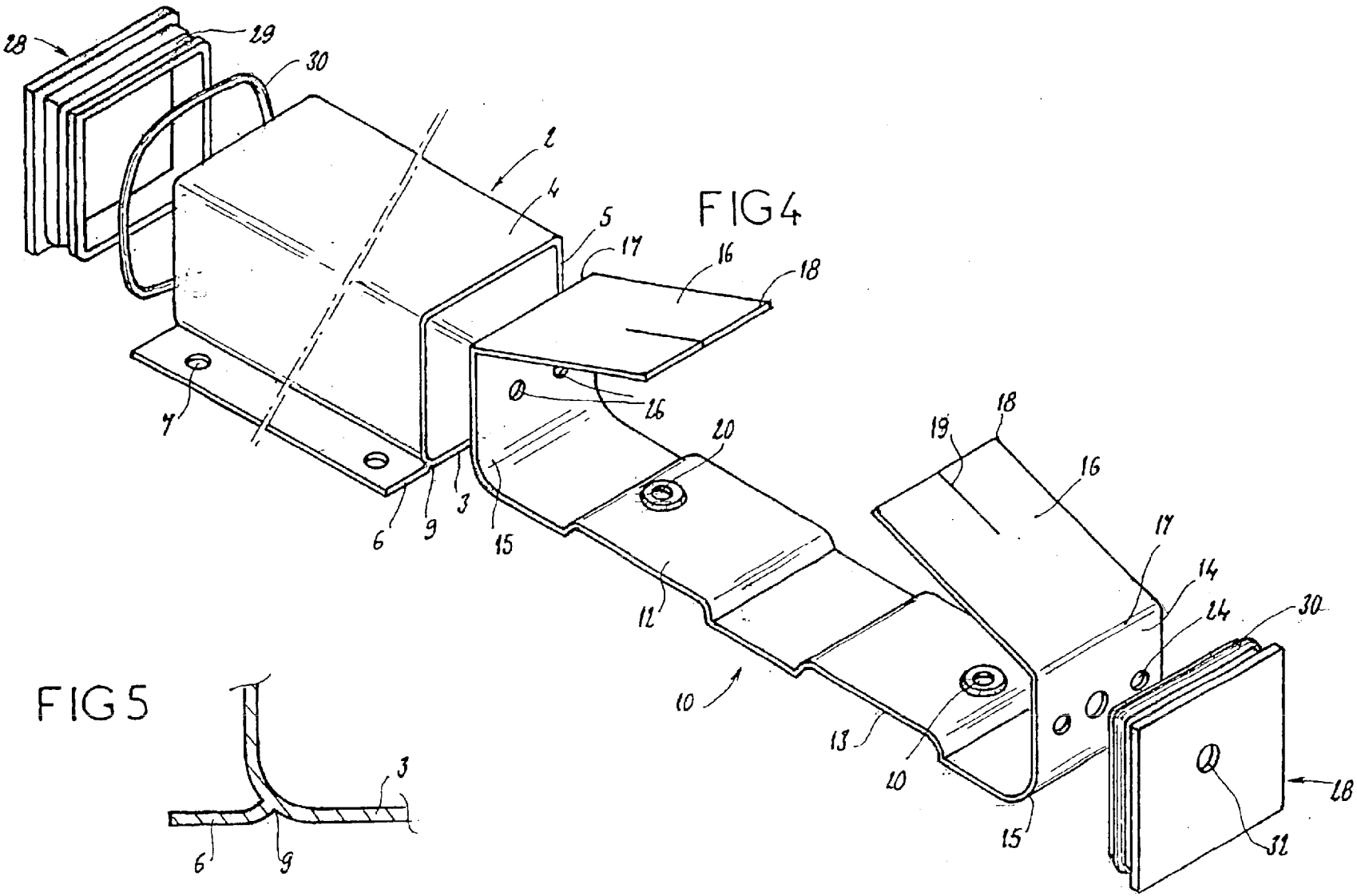
FIG. 4 is an exploded perspective view of a part of the profiled section of the support of the electrical components and of the plugs.
FIG. 5 is a detailed view in cross section and on a larger scale of the connection between a resting lug and the profiled section.

DETAILED DESCRIPTION OF THE INVENTION.

The fixture depicted in the drawing comprises a profiled section 2 made of synthetic material, for example ABS (Acrylonitrile Butadiene Styrene) comprising a bottom wall 3, an upper wall 4 and two side walls 5. The bottom wall 3 is extended by two lugs 6 serving for resting and fixing, for example by screwing through the holes 7, onto a support 8. It should be noted that the thickness of each resting lug 6 is the same as the thickness of the profiled section and that the region of connection between the lug and the profiled section involves a recess 9 so as to keep a constant thickness of material.

The fixture according to the invention also comprises a support 10 for electrical components, these consisting of a metal blade with elastic properties, of a width corresponding more or less to the interior width of the profiled section. This support 10 comprises a base 12 exhibiting two upwardly facing rectangular discontinuities 13. At its ends, this base, the length of which is shorter than the length of the profiled section, is extended by two returns 14 of a height slightly shorter than that of the profiled section and which are each connected to the base by a curved region 15. For its part, each return 14 is extended by a flange 16 to which it is connected via a pronounced fold 17. The free ends of each of the flanges 16 involve a sharp edge 18, a longitudinal and emergent slot 19 in the end of each flange being provided to encourage it to deform.

The base 12 has two holes 20 for the fixing of a plate 22 bearing the ballast 23 of the lighting installation. One of the returns 14 has holes 24 for the clipping of a connector 25, while the other return 14 has holes 26 for the clipping of a starter 27. With the various components mounted on the support, the latter is introduced into the profiled section after the flanges 16 have been bent down slightly. As soon as the support is in its end position, the flanges are released and their ends with the sharp edges 18 anchor into the upper wall 4 of the profiled section, thus translationally immobilizing the support in the profiled section. The profiled section is closed with two plugs 28, each plug having a part 29 intended to be pushed into the profiled section, sealing against the latter by means of an O-ring 30. The plug 28 at the same end as the connector 25 has a hole 32 for the passage of a supply lead 33. Two socket holders 34 each holding a socket 35 are fixed on one of the faces of the profiled section, these sockets serving to mount a sealed fluorescent tube. Electricity is supplied at the socket holders 34.

The fixture thus obtained is perfectly sealed which means that it can be used in various enclosed spaces containing a humid environment, including submerged in a liquid. If there is a need to perform work on one of the electrical components, for example on the starter, it is very easy to access the inside of the profiled section by removing one of the plugs 28. Note that the removal of a plug is not in any way destructive because the plugs are neither welded nor bonded in place.

As is evident from the foregoing, the invention provides a great improvement to the known art by supplying a lighting fixture of a simple structure, which can be fitted quickly and which can be serviced simply and quickly without detracting from its subsequent sealing.

As goes without saying, the invention is not restricted to the sole embodiment of this fixture which has been described hereinabove by way of example; on the contrary, it encompasses all alternative forms thereof. Thus, in particular, the shape of the support could differ, particularly the discontinuities in its base could be structured differently and be different in number or alternatively, the flanges could have bent parts to improve the fastening conditions, without thereby in any way departing from the scope of the invention.

What is claimed is:

1. A lighting fixture for an enclosed space having a humid environment, comprising:

a tubular profiled section made of synthetic material having a rectilinear cross section and a regular profile; and a support carrying electrical components and at least one lamp socket electrical components, the support including a metal blade with elastic properties having a width generally corresponding to an interior width of the profiled section, the blade comprising:

a base for resting against a face of the profiled section, two end returns disposed generally perpendicular to the base and having a height slightly smaller than that of the profiled section, two facing flanges extend respectively from the two end returns including ends for anchoring in an upper wall of the profiled section, and two end plugs for closing the ends of the profiled section, each plug including a part for being pushed into the profiled section, the part including an O-ring.

2. The lighting fixture of claim 1, wherein the base of the support is connected to each return by a curved surface, and each return is connected to the associated flange by a pronounced fold, the metal blade being shaped in such a way that when no action is exerted on the flanges the flanges are inclined upward with respect to a horizontal.

3. The lighting fixture claim 1, wherein the base of the support has at least two upwardly-facing discontinuities.

4. The lighting fixture of claim 1, wherein an end edge of each flange of the support is sharpened on an upwardly facing edge.

5. The lighting fixture of claim 1, wherein each flange has at least one slot opening at an end of the flange.

6. The lighting fixture of claim 1, wherein the profiled section comprises two fixing and resting lugs extending from an exterior wall of the profiled section, and a recess formed between each lug and the body of the profiled section.

* * * * *